US005417199A

United States Patent [19]

Jamieson et al.

[11] Patent Number: 5,417,199

[45] Date of Patent: May 23, 1995

[54] HEATING APPARATUS CONVERTIBLE FOR UPFLOW OR DOWNFLOW OPERATION

[75] Inventors: Donald R. Jamieson, Oakville; Donald R. Jamieson, Etobicoke; Jimmy R. Poe, Oakville, all of Canada

[73] Assignee: Lennox Industries Inc., Richardson, Tex.

[21] Appl. No.: 146,657

[22] Filed: Nov. 2, 1993

[51] Int. Cl.[6] ..... F24H 3/08

[52] U.S. Cl. ..... 126/110 AA; 165/137

[58] Field of Search ..... 165/137; 126/110 AA, 126/114, 110 R

[56] References Cited

U.S. PATENT DOCUMENTS

| | | | |
|---|---|---|---|
| 2,923,287 | 2/1960 | Murphy | 126/110 AA |
| 3,012,762 | 12/1961 | Norris | 165/137 |
| 3,020,820 | 2/1962 | Hopkinson et al. | 165/137 |
| 3,661,140 | 5/1972 | Raleigh | 126/110 R |
| 4,739,746 | 4/1988 | Tomlinson | 126/110 R |

*Primary Examiner*—John C. Fox
*Attorney, Agent, or Firm*—W. Kirk McCord

[57] ABSTRACT

A combustion furnace is provided which is convertible in the field for upflow or downflow operation. The furnace includes a cabinet in which a burner, heat exchanger, air blower and combustion gas blower are located. The burner, heat exchanger and combustion gas blower are mounted on a vestibule panel, which is removably mountable at opposed first and second mounting positions within the cabinet, whereby the burner, heat exchanger and combustion gas blower are reversibly positionable with respect to the air blower. The combustion gas blower is coupled to an elongated flue for exhausting combustion gases from the cabinet and is positionable with respect to the air blower to allow the flue to clear the compartment in which the air blower is located when the apparatus is configured for downflow operation. The vestibule panel includes an extruded portion extending into the air flowing across the heat exchanger. The extruded portion has an opening adapted to receive a temperature sensor, whereby the sensor is retained at a predetermined position in the air flow for sensing the temperature thereof. The heat exchanger preferably includes a plurality of serpentine tubes of generally circular cross-section, through which the combustion gases are drawn by the combustion gas blower. The tubes are crimped at selected locations therealong to define corresponding regions of generally oblong cross-section. The oblong cross-sections slow down the flow of combustion gases through the heat exchanger tubes, thereby enhancing heat transfer from the combustion gases to the air flowing across the outer surfaces of the tubes.

18 Claims, 4 Drawing Sheets

HEATING APPARATUS CONVERTIBLE FOR UPFLOW OR DOWNFLOW OPERATION

TECHNICAL FIELD

This invention relates generally to heating apparatus and in particular to heating apparatus which is convertible in the field for upflow or downflow operation.

BACKGROUND ART

According to prior practice, a typical furnace is configured for only one mode of operation (upflow or downflow), depending upon the configuration of the existing ductwork with which the furnace is installed. For example, if the ductwork is located above the space in which the furnace is installed, the furnace must be configured for upflow operation, whereby air is blown upwardly. Conversely, if the existing ductwork is located below the space in which the furnace is installed, the furnace must be configured for downflow operation, whereby air is blown downwardly. If the existing ductwork is located laterally with respect to the space in which the furnace is installed, the furnace must be positioned horizontally, whereby air is blown horizontally into the supply air duct. Because of the different ductwork configurations, an installer may have to include in his inventory different types of furnaces (e.g., upflow, downflow and horizontal flow)in order to meet anticipated demand.

In a combustion furnace used for space heating, fuel, such as natural gas, is burned in one or more burners and the products of combustion are drawn through a heat exchanger by a combustion gas blower. An elongated flue is located on the discharge side of the combustion gas blower for exhausting products of combustion from the cabinet in which the furnace components are housed. According to prior practice, conversion of a typical combustion furnace from upflow to downflow operation, or vice-versa, involves reversing the respective positions of the burner, heat exchanger and combustion gas blower. It also involves relocation of the furnace control panel on which the electrical components of the furnace are mounted and modification of the compartment in which an air blower (either forced or induced draft) is located, to accommodate passage of the exhaust flue. An airtight seal must be applied between the exhaust flue and the air blower compartment, to prevent supply air from mixing with products of combustion. Obviously, conversion of the typical combustion furnace between upflow and downflow operation must be done in the factory and cannot be readily accomplished in the field.

One type of prior art furnace is field convertible between upflow and downflow operation. In this type of furnace, only the combustion gas blower is reversed by demounting the combustion gas blower and flue plate from a flue box in which products of combustion emanating from the heat exchanger accumulate and remounting the combustion gas blower and flue plate in an opposite position, wherein the flue extends in an opposite direction. Although this type of furnace is convertible between upflow and downflow operation, the reversing procedure may damage gaskets on the flue box and flue plate, which can result in leakage of products of combustion. Further, when the furnace is configured for downflow operation, the flue extends past the burners and blocks access thereto, which makes servicing the burners more difficult. The heat exchanger is not reversible on this type of furnace. There is, therefore, a need for a furnace which is field convertible for upflow or downflow operation, depending upon the configuration of the existing ductwork with which the furnace is to be installed.

Another problem associated with prior art combustion furnaces is the efficiency penalty associated with laminar flow of combustion gases through heat exchanger tubes. Although laminar flow is desirable for effective venting of combustion gases, it is detrimental to furnace efficiency because substantial heat is lost through the flue. One prior art attempt to improve furnace efficiency involves placing baffles at the discharge end of the heat exchanger. Although this configuration is effective in slowing down the combustion gases near the discharge end of the heat exchanger, it is not effective in slowing down the combustion gases throughout the entire length of the heat exchanger tubes. It is not feasible to baffle the entire length of the heat exchanger tubes for mass production. There is, therefore, a need for a heat exchanger with improved efficiency, which is suitable for mass production.

Yet another problem associated with prior art furnaces is the problem of accurately measuring the temperature of the air blown across the heat exchanger (i.e., the supply air stream). Typically, a temperature sensitive bi-metallic disk is positioned for measuring the temperature of the supply air stream. If the temperature becomes abnormally high, the furnace must be automatically shut down and cool down procedures initiated.

Typically, the temperature sensing element is mounted on the ends of two elongated posts, which extend from the furnace vestibule panel into the supply air stream. Because of the non-rigidity of the mounting posts, it is difficult to accurately position the sensing element within the air stream. There is, therefore, a need for improved mounting apparatus for mounting a temperature sensing element for measuring the temperature of a furnace supply air stream.

DISCLOSURE OF INVENTION

In accordance with the present invention, heating apparatus is provided, comprising a cabinet having first and second compartments in fluid communication, burner means located in the cabinet for burning a combustible fuel-air mixture, heat exchanger means located in the first compartment and having opposed inlet and outlet sides, blower means located in the second compartment for directing a flow of air in a predetermined direction across the heat exchanger means, and exhaust means including a flue for exhausting products of combustion from the cabinet. The inlet side of the heat exchanger means is in fluid communication with the burner means for receiving products of combustion. The outlet side of the heat exchanger means is in fluid communication with the exhaust means.

In accordance with one feature of the invention, the heating apparatus further includes mounting means for removably mounting the burner means, heat exchanger means and exhaust means with the cabinet at respective first positions at which the inlet side is proximate to the second compartment and at respective second positions, opposite from the respective first positions, at which the outlet side is proximate to the second compartment, whereby the burner means, heat exchanger means and exhaust means are reversibly positionable with respect to the blower means. The respective first positions correspond to upflow operation of the apparatus, whereby products of combustion are exhausted through the flue in a direction substantially the same as the predetermined direction. The respective second positions correspond to downflow operation of the apparatus, whereby products of combustion are exhausted through the flue in a direction substantially opposite from the predetermined direction. The exhaust means is positionable with respect to the second compartment to allow the flue to clear the second compartment when the apparatus is configured for downflow operation.

In one embodiment, the mounting means includes a panel member on which the burner means, heat exchanger means and exhaust means are mounted. The panel member defines a wall of the first compartment and is removably mountable with the cabinet at a first mounting position, which defines the respective first positions of the burner means, heat exchanger means and exhaust means, and at a second mounting position, opposite from the first mounting position, which defines the respective second positions of the burner means, heat exchanger means and exhaust means, whereby the panel member is reversibly mountable with the cabinet. In accordance with another feature of the invention, sensing means is provided for sensing temperature of the flow of air in the first compartment. The panel member includes an extruded portion extending into the air flow. The extruded portion has an opening adapted to receive the sensing means, whereby the sensing means is retained at a predetermined position with respect to the air flow for sensing the temperature thereof.

In accordance with yet another feature of the invention, the heat exchanger means has a symmetrical configuration between the inlet and outlet sides such that the air flow across the heat exchanger is substantially the same, irrespective of whether the inlet side or the outlet side is proximate to the second compartment. In one embodiment, the heat exchanger means includes a plurality of serpentine tubes in generally parallel relationship, each of the tubes having an inlet end in fluid communication with the burner means and an outlet end in fluid communication with the exhaust means. The inlet ends of the respective tubes define the inlet side and the outlet ends of the respective tubes define the outlet side.

In accordance with still another feature of the invention, the cabinet has opposed first and second sides with respective first and second openings therein. The first opening is offset from an axis extending transverse to the direction of the air flow and passing through the second opening. The first opening is positioned to accommodate passage of a fuel supply line into the cabinet. The first opening functions as a primary opening and as an alternate opening when the apparatus is configured for downflow operation. The second opening is also positioned to accommodate passage of a fuel supply line into the cabinet. The second opening functions as a primary opening when the apparatus is configured for downflow operation and as an alternate opening when the apparatus is configured for upflow operation.

The reversibility of the burner means, heat exchanger means and exhaust means allows the heating apparatus to be converted for upflow or downflow operation. Sideflow operation is also allowed in either the upflow or downflow mounting positions of the burner means, heat exchanger means and exhaust means. By positioning the exhaust means to allow the flue to clear the air blower compartment, no modification of the air blower compartment is required.

In accordance with a preferred embodiment of the invention, the burner means, heat exchanger means, and exhaust means are mounted on a common panel member, which is reversibly mountable with respect to the cabinet, so that the heating apparatus is readily convertible in the field for upflow or downflow operation. Further, the symmetrical configuration of the heat exchanger allows the air flow across the heat exchanger tubes to be substantially the same, irrespective of whether the apparatus is configured for upflow or downflow operation.

BEST MODE FOR CARRYING OUT THE INVENTION

Figure 1:
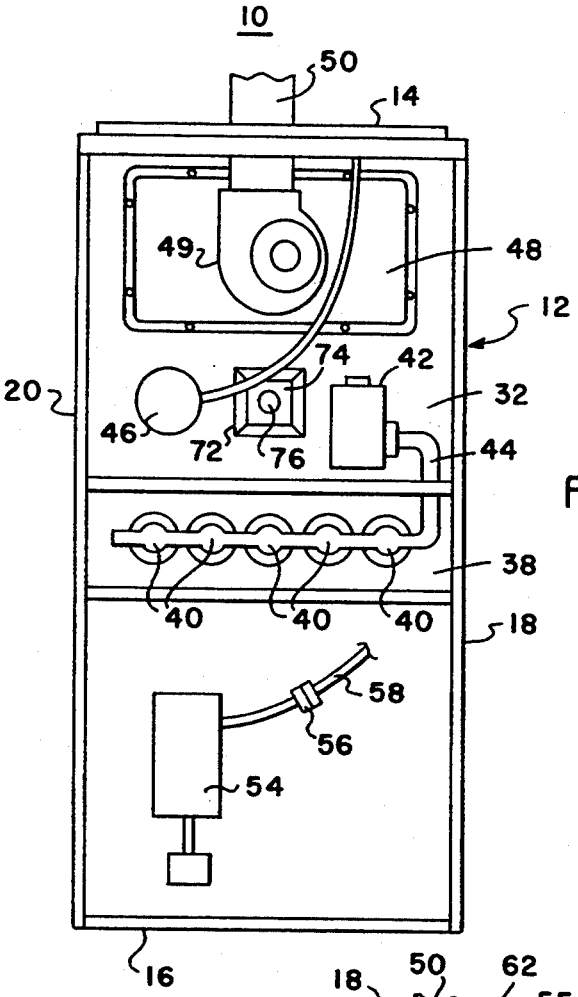
FIG. 1 is a front elevational view of a heating apparatus, according to the present invention, in an upflow position with a front panel of the apparatus removed.

The best mode for carrying out the invention will be described with reference to the accompanying drawings. The drawings are not necessarily to scale and in some instances proportions may have been exaggerated in order to more clearly depict certain features of the invention. Like parts are marked with the same respective numbers throughout the drawings.

Referring to FIGS. 1–5, a heating apparatus 10 is housed in a metal cabinet 12. Cabinet 12 includes top and bottom panels 14 and 16, respectively, opposed side panels 18 and 20, a front panel (not shown), and a back panel 21. The interior of cabinet 12 is divided into a blower compartment 22 and a heat exchanger compartment 24. An air blower 26 is located in compartment 22 and a heat exchanger 28 is located in compartment 24. Heat exchanger 28 is comprised of a plurality of serpentine tubes 30, with each tube 30 having three return bends defining three U-shaped sections. Each tube 30 is preferably made of metal material, such as stainless steel, and has a generally circular cross-section.

A vestibule panel 32 is mounted by means of four attachment screws (not shown) to opposed flanges 34 and 36 extending from respective inner walls of opposed side panels 18 and 20. Insulative material is interposed between each flange 34, 36 and panel 32. As can be best seen in FIG. 3A, panel 32 has four apertures 33, 35, 37 and 39. Flange 34 has two apertures 41 and 43. Flange 36 has two apertures 45 and 47. Apertures 33 and 35 are positioned in alignment with respective apertures 41 and 43 and apertures 37 and 39 are positioned in alignment with respective apertures 45 and 47 when apparatus 10 is configured for upflow operation. Apertures 33 and 35 are positioned in alignment with respective apertures 47 and 45 and apertures 37 and 39 are positioned in alignment with respective apertures 43 and 41 when apparatus 10 is configured for downflow operation. Each of the four pairs of aligned apertures receives an attachment screw for securing vestibule panel 32 to cabinet 12.

Mounted on one side of vestibule panel 32 is a burner assembly 38 having a plurality of burners 40 for burning a combustible fuel-air mixture, a fuel valve 42 and a fuel supply line 44 coupled between fuel valve 42 and burner assembly 38 for supplying combustible fuel to burners 40. Also mounted on the same side of vestibule panel 32 is a pressure switch 46, a flue box 48 for collecting products of combustion, and a combustion gas blower 49 for exhausting products of combustion from flue box 48 by induced draft to the exterior of cabinet 12 through an elongated flue 50.

Heat exchanger 28 is mounted on an opposite side of vestibule panel 32 from burner assembly 38 and blower 49. An inlet end 51 of each heat exchanger tube 30 is in fluid communication with a corresponding one of the burners 40 for receiving products of combustion. Respective portions of tubes 30 adjacent the respective inlet ends 51 define an inlet side 53 of heat exchanger 28. Respective outlet ends 55 of each heat exchanger tube 30 are coupled to flue box 48 and are in fluid communication therewith for discharging products of combustion into flue box 48 after the products of combustion pass through heat exchanger tubes 30. Respective portions of tubes 30 adjacent the respective outlet ends 55 of tubes 30 define an outlet side 57 of heat exchanger 28. Vestibule panel 32 cooperates with side panels 18 and 20 and rear panel 21 to define heat exchanger compartment 24. Blower compartment 22 has a substantially rectangular opening 52 through which blower compartment 22 is in fluid communication with heat exchanger compartment 24. Blower 26 blows air through opening 52 and across heat exchanger 28. The air flowing across heat exchanger 28 is heated by the products of combustion flowing through heat exchanger tubes 30.

An electrical control panel 54 is mounted on the outside of blower compartment 22. A wire harness 56 connects a plurality of electrical wires 58 to control panel 54. Flame roll-out switches (not shown) are provided for shutting off fuel supply to burners 40 in the event of heat exchanger blockage.

Figure 2:
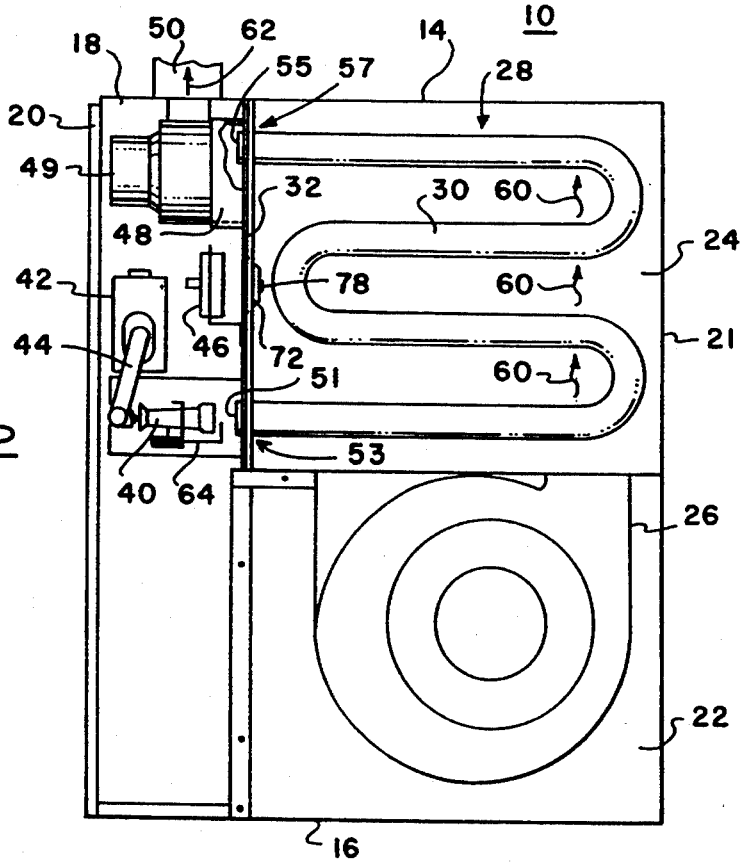
FIG. 2 is a side elevational view of interior components of the heating apparatus of FIG. 1.
Figure 3A:
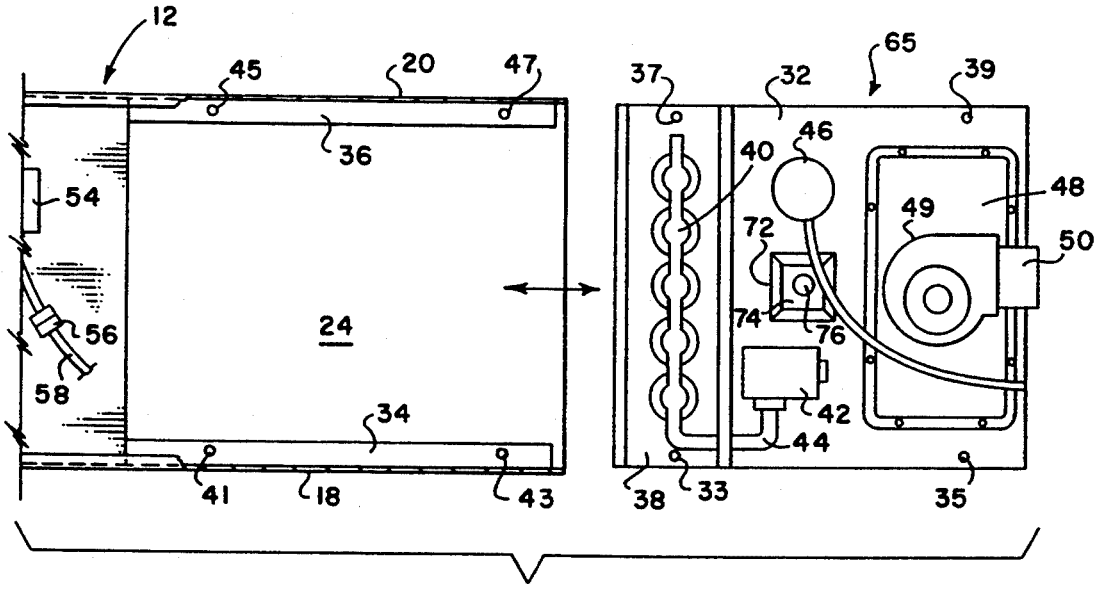
FIGS. 3A and 3B are toil plan and side elevational views, respectively, of a portion of the heating apparatus, illustrating the reconfiguration of the heating apparatus between upflow and downflow positions, according to the present invention.
Figure 3B:
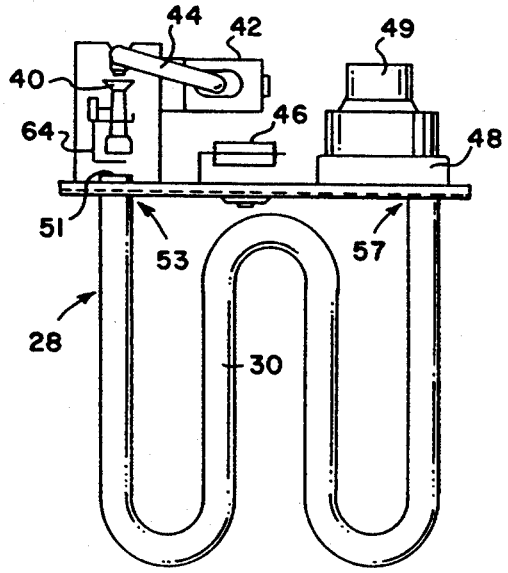

In accordance with the present invention, vestibule panel 32 is removably mountable with cabinet 12 at respective first and second mounting positions, the second mounting position being opposite from the first mounting position, whereby panel 32 is reversibly mountable with cabinet 12. In FIGS. 1 and 2, panel 32 is in the first mounting position, whereby heating apparatus 10 is configured for upflow operation. In the upflow configuration, inlet side 53 of heat exchanger 28 and burner assembly 38 are proximate to blower compartment 22, such that air discharged from compartment 22 encounters inlet side 53 first. Further, when heating apparatus 10 is configured for upflow operation, products of combustion are discharged from cabinet 12 by combustion gas blower 49 in the same direction. Arrows 60 indicate the generally upward movement of air across heat exchanger 28 and Arrow 62 indicates the generally upwardly direction of products of combustion discharged from cabinet 12 through flue 50.

Heating apparatus 10 can be quickly and conveniently reconfigured for downflow operation as follows: (1) place apparatus 10 in a horizontal position with rear panel 21 in contact with a floor or other support surface; (2) disconnect wire harness 56 and the electrical wires (not shown) connected to an ignitor 64 and flame sensor (not shown) in burner assembly 38; (3) remove the screws (not shown) securing bottom panel 16 to cabinet 12 and remove bottom panel 16; (4) remove the screws (not shown) securing top panel 14 to cabinet 12 and reinstall top panel 14 on the bottom of cabinet 12; (5) remove the four attachment screws securing vestibule panel 32 and slide the entire module 65 (FIG. 3A), which includes vestibule panel 32, heat exchanger 28, burner assembly 38 and blower 49, out through the top of cabinet 12; (6) rotate module 65 180° and slide module 65 back into cabinet 12 through the top thereof; (7) resecure vestibule panel 32 using the same four attachment screws; (8) install bottom panel 16 on the top of cabinet 12 using four attachment screws (not shown); (9) reconnect ignitor and flame sensor wires (not shown) to ignitor 64 and to the flame sensor (not shown); (10) reconnect wire harness 56; (11) replace front panel (not shown); and (12) stand cabinet 12 on its top. Reconfiguration is readily accomplished in the field, thereby satisfying the need for a heating apparatus which is field convertible for upflow or downflow operation. Panel 32, heat exchanger 28, burner assembly 38, fuel valve 42, fuel supply line 44, pressure switch 46, flue box 48, blower 49 and flue 50 comprise a reversible module 65.

Figure 4:
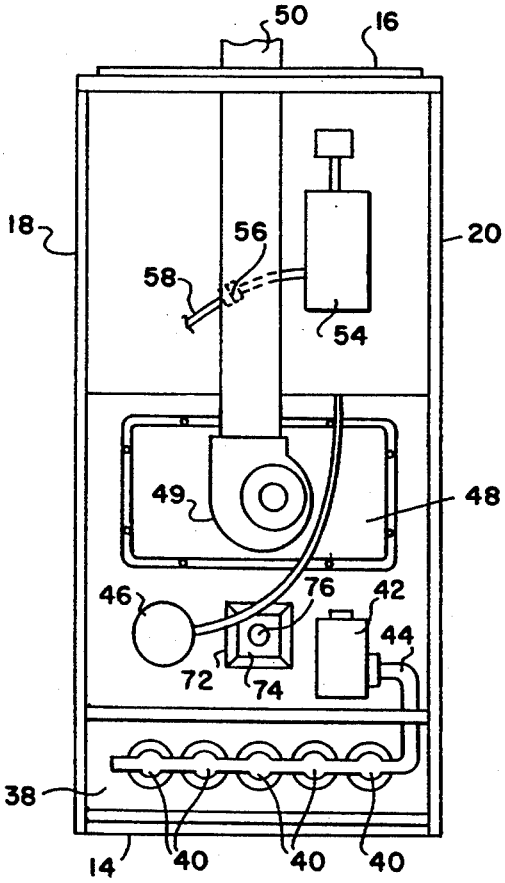
FIG. 4 is a front elevational view of the heating apparatus in a downflow position.
Figure 5:
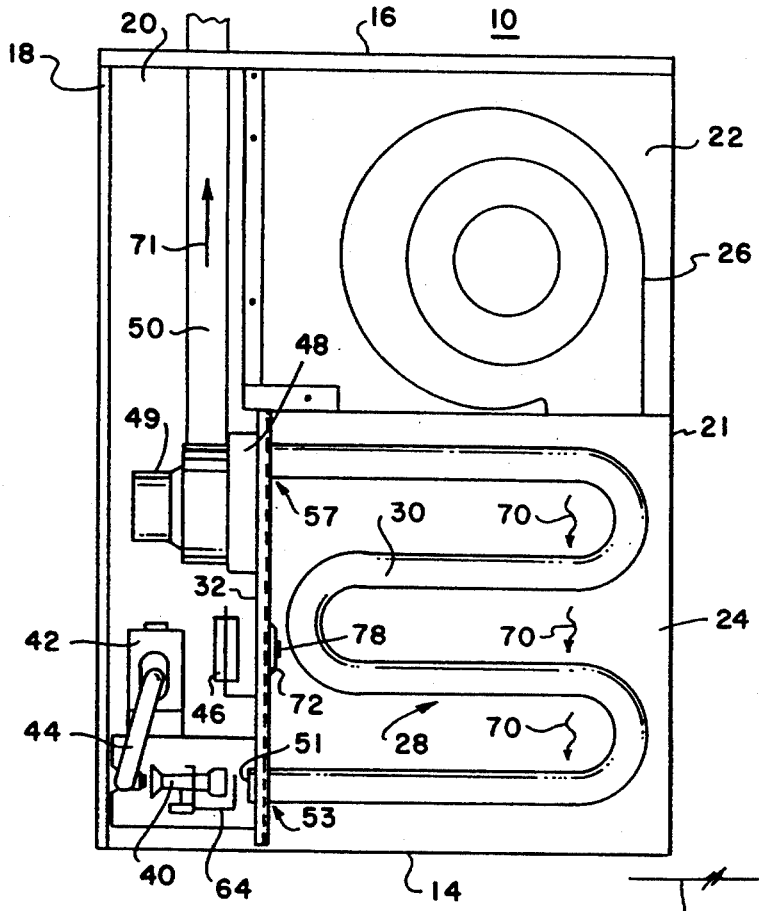
FIG. 5 is a side elevational view of the interior components of the heating apparatus in the downflow position.

When apparatus 10 is reconfigured for downflow operation, as shown in FIGS. 4 and 5, outlet side 57 of heat exchanger 28 and combustion gas blower 49 are proximate to blower compartment 22 and air flow through heat exchanger 28 is in a downward direction, as indicated by Arrows 70. The air flow is in a direction opposite from the direction (Arrow 71) in which products of combustion are discharged from cabinet 12 because it is always desirable to discharge products of combustion upwardly.

Heating apparatus 10 can be configured for sideflow operation by turning cabinet 12 so that one of the side panels 18 and 20 is in contact with a floor or other support surface. Sideflow operation is available when apparatus 10 is in either an upflow or downflow configuration. The upflow configuration is preferable because flue 50 will not inhibit access to blower compartment 22 as it does in the downflow configuration (see FIG. 5). Top panel 14 has an opening to accommodate the passage of flue 50 therethrough. As such, top panel 14 is always on the uppermost portion of apparatus 10 (i.e., on the cabinet top in the upflow configuration and on the cabinet bottom in the downflow configuration).

Heat exchanger 28 has a symmetrical configuration between the inlet and outlet sides 53 and 57, such that the air flow across heat exchanger 28 is substantially the same, irrespective of whether inlet side 53 or outlet side 57 is proximate to blower compartment 22. Heat exchanger compartment 24 also has a symmetrical configuration such that the air flow across heat exchanger 28 is substantially the same, irrespective of whether apparatus 10 is configured for upflow or downflow operation. The symmetrical configuration of heat exchanger compartment 24 is achieved by positioning burner assembly 38 outside of compartment 24 so that no portion of burner assembly 38 protrudes into compartment 24. If burner assembly 38 did protrude into compartment 24, the width of the air 7passage through heat exchanger 28 would be constricted in the vicinity of burner assembly 38. In the upflow configuration, this constricted area would be proximate to blower compartment 22, while in the downflow configuration, the constricted area would be located distally with respect to compartment 22. The distance between compartment 22 and the tube 30 nearest compartment 22 is also substantially the same in the upflow and downflow configurations.

Combustion air blower 49 is located with respect to blower compartment 22 to allow flue 50 to clear blower compartment 22 when apparatus 10 is configured for downflow operation, as can be best seen in FIG. 5. This is accomplished by separating blower 49 from compartment 22 along a lateral axis relative to the direction of air flow.

Vestibule panel 32 has an extruded portion 72 extending into heat exchanger compartment 24. Base 74 of extruded portion 72 has a circular opening 76, which is adapted to receive a temperature sensor 78. Sensor 78 is mounted on base 74 and extends through opening 76 into compartment 24. As can be best seen in FIGS. 2 and 5, extruded portion 72 extends into compartment 24 approximately 21 millimeters, such that sensor 78 is located is approximately 19 millimeters from the nearest heat exchanger tube 30. Extruded portion 72 is substantially centrally located on panel 32. Sensor 78 is rigidly mounted with extruded portion 72 so that sensor 78 can be accurately positioned within the air flow across heat exchanger 28.

Figure 6A:
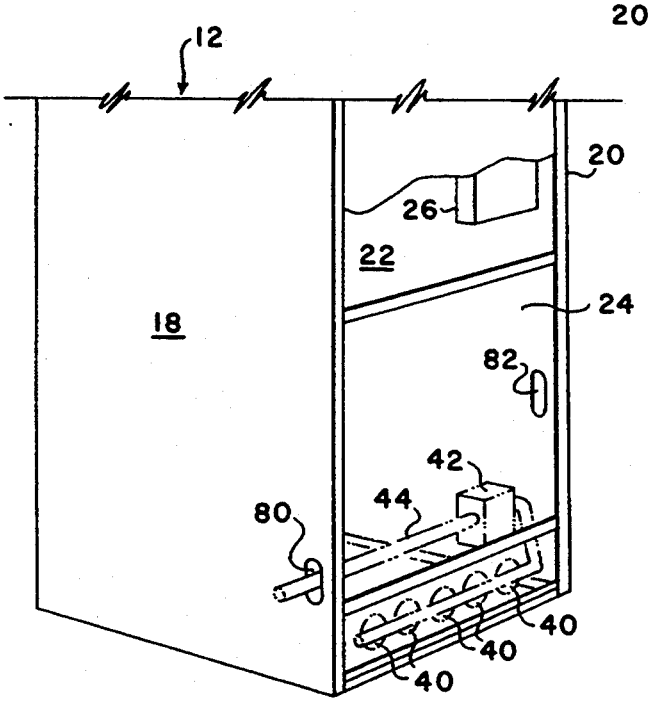
FIGS. 6A and 6B are perspective views of a portion of the heating apparatus, showing the respective locations of two fuel supply line openings.
Figure 6B:
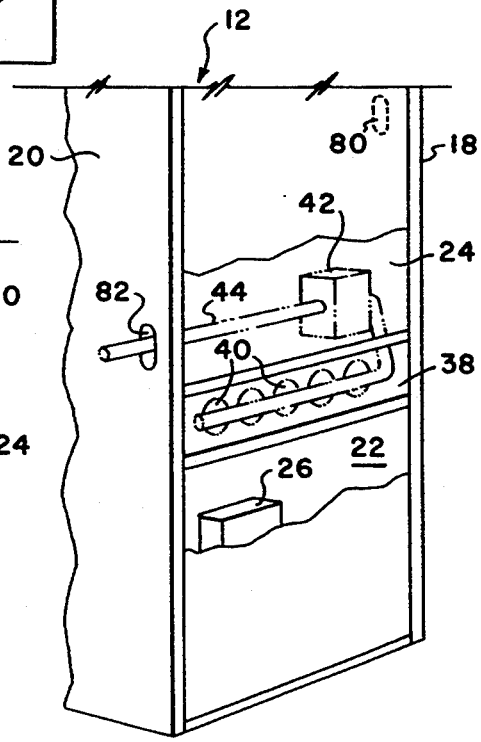
Figure 7:
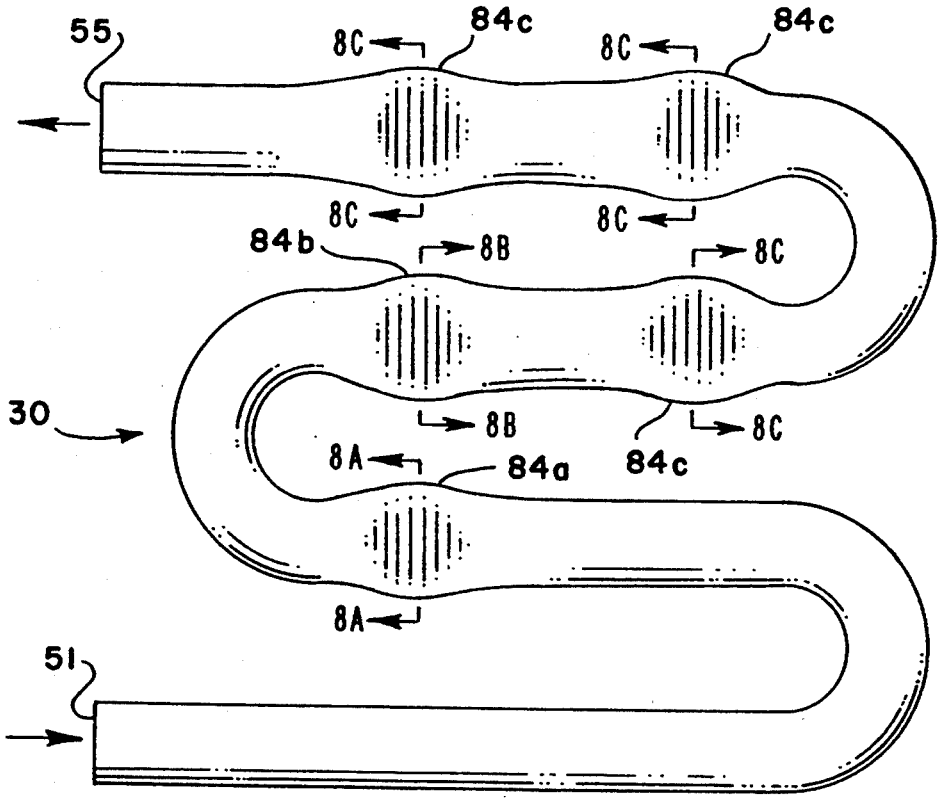
FIG. 7 is a side elevational view of a heat exchanger tube crimped at selected locations, according to the present invention.

Referring now to FIGS. 6A and 6B, side panels 18 and 20 have respective elliptically shaped openings 80 and 82. Opening 80 is offset from opening 82 such that an axis extending transverse to the direction of air flow and passing through opening 82 does not pass through opening 80. Opening 80 is positioned to accommodate passage of fuel supply line 44 into cabinet 12, as a primary opening when apparatus 10 is configured for downflow operation (see FIG. 6A) and as an alternate opening when apparatus 10 is configured for upflow operation. Opening 82 is positioned to accommodate passage of fuel supply line 44 into cabinet 12, as a primary opening when apparatus 10 is configured for upflow operation (see FIG. 6B) and as an alternate opening when apparatus 10 is configured for downflow operation.

Referring to FIGS. 7 and 8A–C, each heat exchanger tube 30 has a generally circular cross-section, punctuated at selected locations therealong by respective regions of generally oblong cross-section. Each tube 30 is preferably crimped at each of the selected locations to define the corresponding region **84*a*, 84*b*, 84*c* of generally oblong cross-section. The oblong cross-section of each region 84*a*, 84*b*, 84*c* has a major dimension and a minor dimension. The minor dimension is sequentially decreased and the major dimension is sequentially increased from the inlet end 51 to the outlet end 55 of the corresponding tube 30, such that the oblong cross-sections of the respective regions 84*a*, 84*b*, 84*c* become more elongated in sequence from inlet end 51 to outlet end 55. This accomplished by successively crimping each tube 30 by a greater amount from inlet end 51 to outlet end 55**.

Figure 8A:
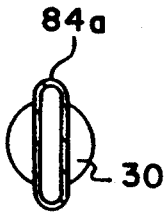
FIGS. 8A, 8B and 8C are respective cross-sectional views taken along the lines A—A, B—B and C—C, respectively, of FIG. 7.
Figure 8B:
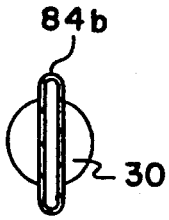
Figure 8C:
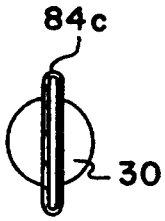

For example, as shown in FIGS. 8A–C, the minor dimension of the first crimped region **84*a*(i.e., the region closest to inlet end 41) is preferably on the order of ½-inch, as shown in FIG. 8A. The minor dimension of the next crimped region 84*b* is preferably on the order of ½-inch, as shown in FIG. 8B. The minor dimension of each of the last three crimped regions 84*c* is preferably on the order of ⅜-inch, as shown in FIG. 8C. Crimped regions 84*a*, 84*b*, 84*c* slow down the flow of combustion gases through the corresponding heat exchanger tube 30, thereby enhancing heat transfer from the combustion gases to the air flowing across the outer surfaces of the corresponding tubes 30**. Further, the crimped configuration is suitable for mass production of heat exchanger tubes.

The best mode for carrying out the invention has been described hereinabove with reference to the accompanying drawings. Since it is obvious that changes in and additions to the hereinabove-described best mode may be without departing from the nature, spirit and scope of the invention, the invention is not to be limited to the above-described details.

We claim:

1. Heating apparatus, comprising:

a cabinet having first and second compartments in fluid communication;

burner means located in said cabinet for burning a combustible fuel-air mixture;

heat exchanger means located in said first compartment and having opposed inlet and outlet sides, said inlet side being in fluid communication with said burner means for receiving products of combustion;

blower means located in said second compartment for directing a flow of air in a predetermined direction across said heat exchanger means, whereby heat is transferred from the products of combustion to the air;

exhaust means in fluid communication with said outlet side, said exhaust means including a flue for exhausting the products of combustion from said cabinet;

mounting means for removably mounting said burner means, said heat exchanger means and said exhaust means with said cabinet at respective first positions at which said inlet side is proximate to said second compartment and at respective second positions, opposite from the respective first positions, at which said outlet side is proximate to said second compartment, whereby said burner means, said heat exchanger means and said exhaust means are reversibly positionable with respect to said second compartment, said respective first positions corresponding to upflow operation of said apparatus, whereby the products of combustion are exhausted through said flue in substantially the same direction as said predetermined direction, said respective second positions corresponding to downflow operation of said apparatus, whereby the products of combustion are exhausted through said flue in a substantially opposite direction from said predetermined direction;

said exhaust means being positionable with respect to said second compartment to allow said flue to clear said second compartment when said apparatus is configured for said downflow operation;

said mounting means including a panel member on which said burner means, said heat exchanger means and said exhaust means are mounted, said panel member defining a wall of said first compartment and being removably mounted with said cabinet, said panel member being mountable with said cabinet at opposed first and second mounting position, said first mounting position defining the respective first positions of said burner means, said heat exchanger means and said exhaust means, said second mounting position defining the respective second positions of said burner means, said heat exchanger means and said exhaust means;

said cabinet having first and second apertures on one side thereof and third and fourth apertures on an opposite side thereof, said panel member having fifth and sixth apertures on one side thereof and seventh and eighth apertures on an opposite side thereof, said first and second apertures being aligned with the respective fifth and sixth apertures and said third and fourth apertures being aligned with the respective seventh and eighth apertures when said apparatus is configured for upflow operation, said first and second apertures being aligned with the respective eighth and seventh apertures and said third and fourth apertures being aligned with the respective sixth and fifth apertures when said apparatus is configured for downflow operation, each aligned pair of apertures being adapted to receive an attachment member for mounting said panel member with said cabinet, whereby said panel member is reversibly mountable with said cabinet.

2. Apparatus of claim 1 wherein said flue extends in a substantially opposite direction from said predetermined direction when said apparatus is configured for said downflow operation, said exhaust means being separated from said second compartment along a lateral axis relative to said predetermined direction sufficiently to allow said flue to extend past said second compartment without penetrating into said second compartment.

3. Apparatus of claim 1 further including sensing means for sensing temperature of said flow of air, said panel member including an extruded portion extending into said flow of air, said extruded portion having an opening adapted to receive said sensing means, whereby said sensing means is retained at a predetermined position with respect to said flow of air for sensing the temperature thereof.

4. Apparatus of claim 1 wherein said heat exchanger means has a symmetrical configuration between said inlet side and said outlet side such that air flow across said heat exchanger means is substantially the same, irrespective of whether said inlet side or said outlet side is proximate to said second compartment.

5. Apparatus of claim 4 wherein said heat exchanger means includes a plurality of serpentine tubes in generally parallel relationship, each of said tubes having an inlet end in fluid communication with said burner means and an outlet end in fluid communication with said exhaust means, the inlet ends of the respective tubes defining said inlet side, the outlet ends of the respective tubes defining said outlet side.

6. Apparatus of claim 1 wherein said cabinet has opposed first and second sides and first and second openings in the respective first and second sides, said first opening being offset from said second opening in a direction parallel to said predetermined direction such that an axis transverse to said predetermined direction and passing through said second opening does not pass through said first opening, said first and second openings being adapted to accommodate passage of a fuel supply line into said cabinet.

7. Heating apparatus, comprising:

a cabinet, the interior of which is divided into first and second compartments, said first and second compartments being in fluid communication;

burner means located in said cabinet for burning a combustible fuel-air mixture;

heat exchanger means located in said first compartment and having opposed inlet and outlet sides, said inlet side being in fluid communication with said burner means for receiving products of combustion;

blower means located in said second compartment for directing a flow of air in a predetermined direction across said heat exchanger means, whereby heat is transferred from the products of combustion to the air;

exhaust means in fluid communication with said outlet side, said exhaust means including a flue for exhausting the products of combustion from said cabinet;

a panel member on which said burner means, said heat exchanger means and said exhaust means are mounted, said panel member being located in said cabinet and being removably mounted therewith, said panel member being mountable with said cabinet at opposed first and second mounting positions, whereby said panel member is reversibly positionable with respect to said cabinet, said panel member cooperating with a portion of said cabinet to define said first compartment, said first mounting position defining corresponding first positions of said burner means, said heat exchanger means and said exhaust means with respect to said second compartment at which said inlet side is proximate to said second compartment, said second mounting position defining corresponding second positions of said burner means, said heat exchanger means and said exhaust means with respect to said second compartment, opposite from said respective first positions, at which said outlet side is proximate to said second compartment, whereby said burner means, said heat exchanger means and said exhaust means are reversibly positionable with respect to said blower means, said respective first positions corresponding to upflow operation of said apparatus, whereby the products of combustion are exhausted through said flue in substantially the same direction as said predetermined direction, said respective second positions corresponding to downflow operation of said apparatus, whereby the products of combustion are exhausted through said flue in a substantially opposite direction from said predetermined direction;

said exhaust means being positionable with respect to said second compartment to allow said flue to extend through said cabinet laterally of said second compartment when said apparatus is configured for said downflow operation.

8. Apparatus of claim 7 further including sensing means for sensing temperature of the flow of air, said panel member including an extruded portion extending into the flow of air, said extruded portion having an aperture adapted to receive said sensing means, whereby said sensing means is retained at a predetermined position with respect to the flow of air for sensing the temperature thereof.

9. Apparatus of claim 7 wherein said cabinet has opposed first and second sides and first and second openings in the respective first and second sides, said first opening being offset from said second opening in a direction parallel to said predetermined direction such that an axis transverse to said predetermined direction and passing through said second opening does not pass through said first opening, said first and second openings being adapted to accommodate passage of a fuel supply line into said cabinet.

10. Heating apparatus, comprising:

a cabinet, the interior of which is divided into first and second compartments, said first and second compartments being in fluid communication;

a panel member located in said cabinet and removably mounted therewith, said panel member being mountable with said cabinet at opposed first and second mounting positions, whereby said panel member is reversibly positionable with respect to said cabinet, said panel member cooperating with a portion of said cabinet to define said first compartment;

burner means for burning a combustible fuel-air mixture, said burner means being mounted with said panel member;

heat exchanger means having opposed inlet and outlet sides, said inlet side being in fluid communication with said burner means for receiving products of combustion, said heat exchanger means being mounted with said panel member and being located in said first compartment;

blower means for directing a flow of air in a predetermined direction across said heat exchanger means, whereby heat is transferred from the products of combustion to the air, said blower means being located in said second compartment;

exhaust means in fluid communication with said outlet side for exhausting the products of combustion from said cabinet, said exhaust means being mounted with said panel member;

said first mounting position corresponding to upflow operation of said apparatus, whereby the products of combustion are exhausted from said cabinet by said exhaust means in substantially the same direction as said predetermined direction, said second mounting position corresponding to downflow operation of said apparatus, whereby the products of combustion are exhausted from said cabinet by said exhaust means in a substantially opposite direction from said predetermined direction.

11. Apparatus of claim 10 wherein said exhaust means includes a flue for exhausting the products of combustion from said cabinet, said exhaust means being positionable with respect to said second compartment such that when said panel member is in said second mounting position, said flue extends through said cabinet laterally of said second compartment.

12. Apparatus of claim 11 wherein said cabinet has opposed first and second ends, said first compartment extending from said first end to said second compartment, said second compartment extending from said first compartment to said second end, said exhaust means being located with respect to said second compartment such that when said panel member is in said second mounting position, said flue extends through said second end laterally of said second compartment.

13. Apparatus of claim 10 further including sensing means for sensing temperature of said flow of air, said panel member including an extruded portion extending into said flow of air, said extruded portion having an opening adapted to receive said sensing means, whereby said sensing means is retained at a predetermined position with respect to said flow of air for sensing the temperature thereof.

14. Apparatus of claim 10 wherein said heat exchanger means has a symmetrical configuration between said inlet side and said outlet side such that said flow of air across said heat exchanger is substantially the same, irrespective of whether said inlet side or said outlet side is proximate to said second compartment, said inlet side being proximate to said second compartment when said panel member is in said first mounting position, said outlet side being proximate to said second compartment when said panel member is in said second mounting position.

15. Apparatus of claim 14 wherein said heat exchanger means includes a plurality of serpentine tubes in generally parallel relationship, each of said tubes having an inlet end in fluid communication with said burner means and an outlet end in fluid communication with said exhaust means, the inlet ends of the respective tubes defining said inlet side, the outlet ends of the respective tubes defining said outlet side.

16. Apparatus of claim 10 wherein said cabinet has opposed first and second sides and first and second openings in the respective first and second sides, said first opening being offset from said second opening in a direction parallel to said predetermined direction such that an axis transverse to said predetermined direction and passing through said second opening does not pass through said first opening, said first and second openings being adapted to accommodate passage of a fuel supply line into said cabinet.

17. Apparatus of claim 10 wherein said cabinet has mounting means engageable with said panel member for mounting said panel member with said cabinet, said apparatus further including coupling means for detachably coupling said panel member to said cabinet.

18. Apparatus of claim 17 wherein said cabinet has opposed first and second sides, said mounting means including opposed first and second mounting flanges extending into said cabinet from the respective first and second sides, said first and second mounting flanges being adapted to engage said panel member, said coupling means being adapted to detachably couple said panel member to said first and second mounting flanges, whereby said panel member is detachably coupled to said cabinet.

* * * * *